United States Patent [19]

Azzalin

[11] Patent Number: 4,926,663

[45] Date of Patent: May 22, 1990

[54] COMBINATION LOCKS FOR SUITCASES, BAGS AND THE LIKE

[75] Inventor: Italo Azzalin, Varese, Italy

[73] Assignee: C.G.V. S.p.A., Italy

[21] Appl. No.: 278,192

[22] Filed: Nov. 30, 1988

[30] Foreign Application Priority Data

Dec. 10, 1987 [IT] Italy ..... 22939 A/87

[51] Int. Cl.[5] ..... E05B 65/48

[52] U.S. Cl. ..... 70/74; 70/312

[58] Field of Search ..... 70/68–76, 70/312–315, 320, 322, 326, 328

[56] References Cited

U.S. PATENT DOCUMENTS

| | | | |
|---|---|---|---|
| 3,434,314 | 3/1969 | Atkinson | 70/76 |
| 3,482,421 | 12/1969 | Franzen | 70/74 |
| 3,677,042 | 7/1972 | Atkinson | 70/70 |
| 3,845,644 | 11/1974 | Lindner | 70/74 |
| 4,155,234 | 5/1979 | Bako | 70/70 X |
| 4,343,165 | 8/1982 | Bako | 70/312 |
| 4,596,125 | 6/1986 | Castiglioni et al. | 70/312 |
| 4,669,285 | 6/1987 | Kim | 70/312 |
| 4,719,777 | 1/1988 | Hwang | 70/312 |
| 4,779,907 | 10/1988 | Yu | 70/312 X |
| 4,782,673 | 11/1988 | Castelli et al. | 70/312 X |
| 4,852,372 | 8/1989 | Ling | 70/74 X |

*Primary Examiner*—Robert L. Wolfe
*Assistant Examiner*—Suzanne L. Dino
*Attorney, Agent, or Firm*—Steinberg & Raskin

[57] ABSTRACT

A combination lock particularly for suitcase, bags and the like comprising: (a) an engagement member to be fixed to one part of the article; (b) a combination mechanism fixed to the other part of the article and provided with a coupling arranged to cooperate with said engagement member, said mechanism comprising rotatable discs for setting the combination, and a like number of stop bodies removably engaged with said discs in such a manner as to be rotated with these latter during engagement but to enable the combination to be changed during disengagement. The combination mechanism further comprises a sliding grip provided with inclined guide tracks in which pins rigid with sliders carrying the stop bodies slide, said sliding—which can occur when the correct combination is set—generating an approach movement of the bodies and causing the disengagement between bodies and the rotatable discs so as to enable the user to change the lock combination the sliding grip being formed in such a manner as to generate with its movement the disengagement between the engagement member and the coupling.

15 Claims, 5 Drawing Sheets

1
3
4
5
6
7
11
12
13
14
16
17
18
19
20
21
22
23
24
26
27
28
29
30
31
32
34
38
39
40
41
42
44
45
100
II
III
IV

COMBINATION LOCKS FOR SUITCASES, BAGS AND THE LIKE

BACKGROUND OF THE INVENTION

This invention relates to a combination lock particularly for suitcases, bags and the like comprising an engagement member to be fixed to one part of the article and a combination mechanism fixed to the other part of the article and provided with coupling means arranged to cooperate with said engagement member, said mechanism comprising rotatable discs for setting the combination, and a like number of stop bodies removably engaged with said discs in such a manner as to be rotated with these latter during the engagement but to enable the combination to be changed during disengagement.

Such a look is the subject of a previous patent filed in the name of the present applicant under No. 4,596,125. The construction described in the aforesaid document attains many advantages over the then known state of the art, and in particular results in a small-dimension lock of reliable operation comprising a small number of components.

This construction however cannot be adapted simply and quickly to to one or other of the two different types of closure, i.e. closure with a frontal striker superposed on the outer plate of the lock, or head-on closure with a bayonet-type striker, i.e. with this latter inserted into the top of the lock.

In addition, known commercially available locks such as that protected by the aforesaid invention still have a substantially large number of components, particularly in that part of the lock which moves the coupling means following the movement of the grip.

SUMMARY OF THE INVENTION

An object of the invention is therefore to provide a compact and reliable combination lock with a small number of components in which the operations involved in opening the lock and changing the combination can be carried out simultaneously in any natural manner.

A further object is to provide a lock which allows easy and fast adaption to the aforesaid frontal striker or bayonet-type striker, to give the lock high versatility and enable the manufacturer to obtain true financial advantage both in terms of the equipment for producing the lock (in particular the dies) and in terms of the actual production stages.

A further object is to provide a lock in which the components can be easily mounted and assembled leading to further economical advantages both to the manufacturer and thus to the user.

These and further objects are attained by a lock of the aforesaid type, characterized in that the combination mechanism comprises a sliding grip provided with inclined guide tracks in which pins rigid with the stop bodies slide, said sliding—which can occur when the correct combination is set—generating an approach movement of said bodies and causing disengagement between said bodies and the rotatable discs to enable the user to change the lock combination, said grip being formed in such a manner as to generate with its movement the disengagement between the engagement member and the coupling means.

BRIEF DESCRIPTION OF THE DRAWINGS

The present invention will be more apparent from the accompanying drawing given by way of non-limiting example and in which.

DESCRIPTION OF THE PREFERRED EMBODIMENTS

Figure 1:
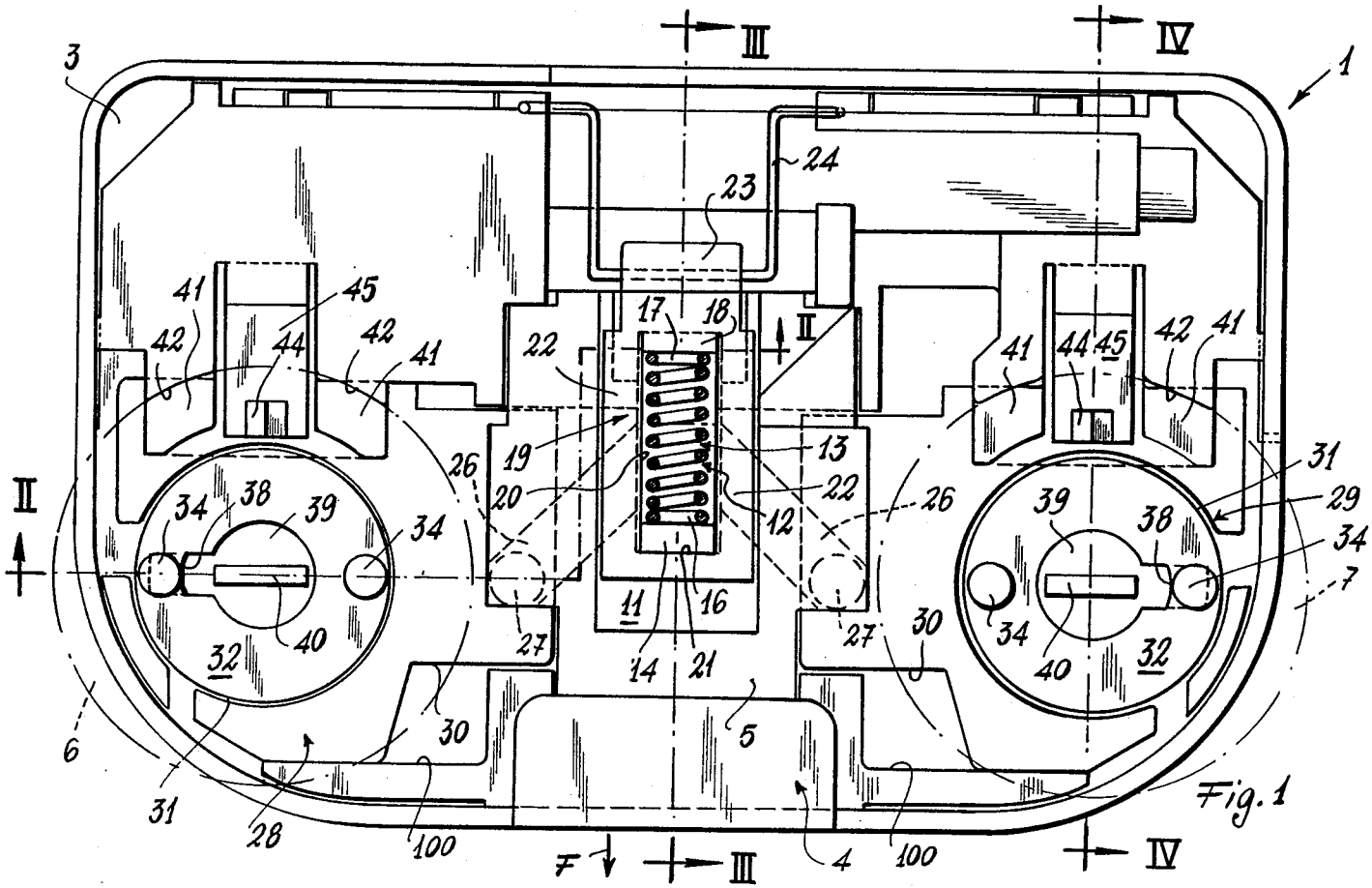
FIG. 1 is a plan view of the front coupling lock according to the present invention after removing one of the two constituent components of the box casing for the lock.
Figure 2:
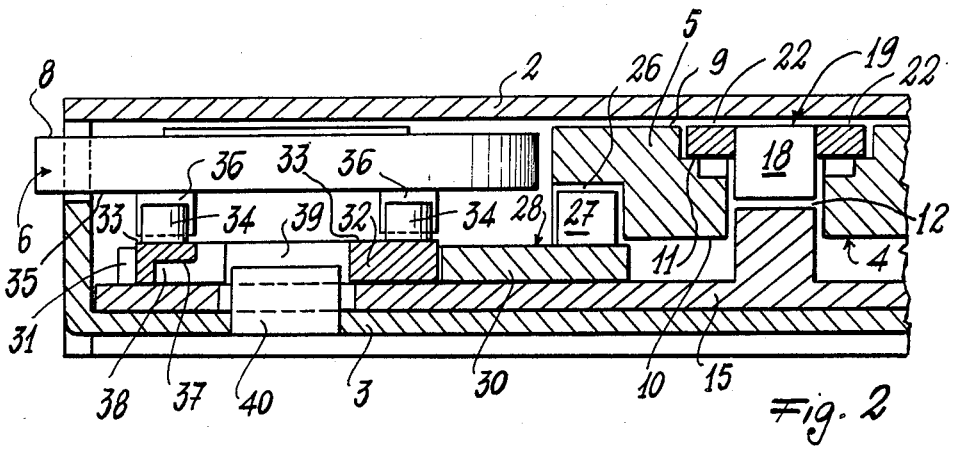
FIG. 2 is a section through the lock on the line II—II of FIG. 1 with the casing complete.
Figure 3:
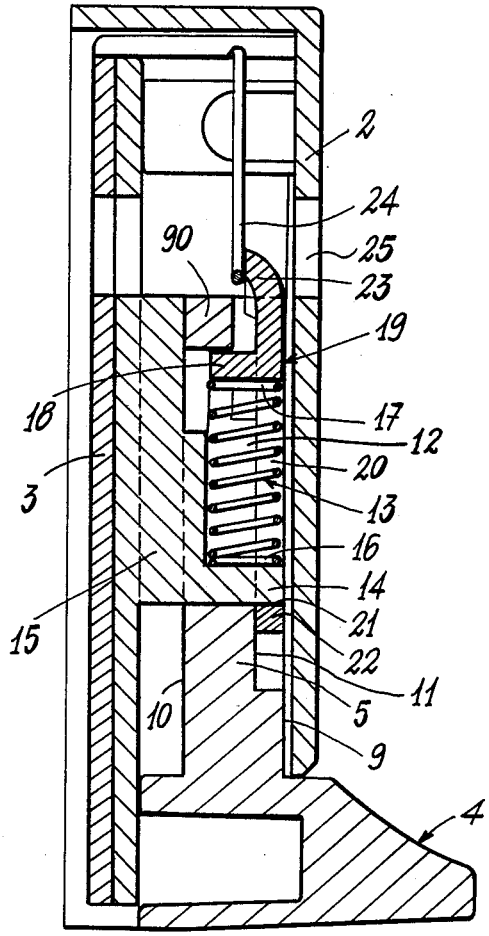
FIG. 3 is a section through the lock on the line III—III of FIG. 1 with the casing complete.
Figure 4:
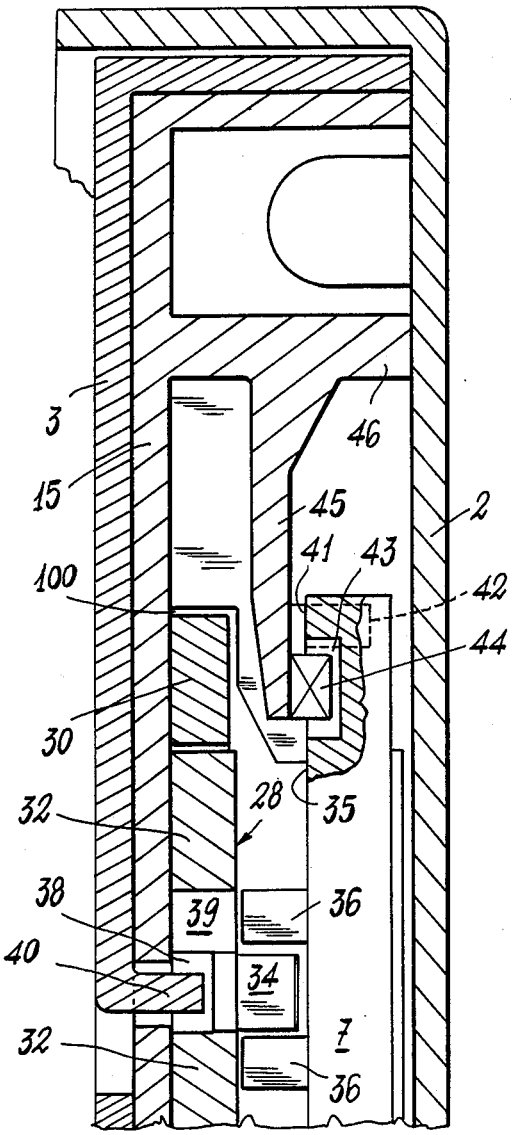
FIG. 4 is a section through the lock on the line IV—IV of FIG. 1 with the casing complete.

In said figures and in particular FIGS. 1 to 4, the reference numeral 1 indicates overall the outer casing of the combination lock mechanism. Said casing comprises in particular two components or an upper and lower part 2, 3 which are connected together in any known manner, one of them, the lower part 3, comprising known members, not shown, for fixing the lock to a part of the suitcases, bag or the like to which said lock is to be fixed.

Emerging form the lock casing 1 and specifically from the upper part of this casing there is a grip 4 in one piece with an element 5 which is slidingly guided (arrow F) within the casing 1. In the same manner, but in opposing lateral positions, two combination discs 6 and 7 project partially from said casing and carry numerical and/or alphanumerical characters on one face 8.

The mobile element 5 with which the grip 4 is rigid has an upper surface 9 and a lower surface 10. The upper surface 9 comprises a sunken zone 11 provided with an elongated hole 12 able to receive a compression spring 13 and at one end of which there is a shoulder 14 rising orthogonally from a base part 15 rigid with the lower part 3 of the casing 1. Against said shoulder 14 there rests one end 16 of the spring 13 inserted in the elongated hole 12 of the mobile element 5, its other end 17 resting against a right-angle bent side 18, facing the lower part 3 of the casing, of coupling means 19 for an engagement member (not shown) to be fixed to another part of the suitcases, bag or the like. Said coupling means 19 comprises a rectangular slot 20 at one end of which the right-angle bent side 18 is present, said slot 20 being positioned in correspondence with the elongated hole 12 of the mobile element 5 when the lock has been assembled. The other end 21 of the slot 20, distant from that housing the right-angle bent side 18, is disposed beyond the shoulder 14 which rises from the base part 15. The coupling means 19 also comprises: a part 22 surrounding the rectangular slot 20 and resting against the sunken zone 11 provided on the upper surface 9 of the mobile element 5, and a substantially arcuate end 23 facing that end of the mobile element distant from the end on which the grip 4 is disposed. Said arcuate end 23 is disposed above a substantially U-shaped spring 24 and is arranged to cooperate with the said engagement member, it extending above one end 90 of the mobile element 5. In order to cooperate with said arcuate member 23, this engagement member penetrates into the lock casing 1 through a slot 25 provided in the upper part 2 of the casing.

The mobile element 5 comprises on its lower surface 10 two guide tracks 26 inclined to its longitudinal movement axis A (this axis coinciding with the section line III—III of FIG. 1). In said guide plates 26 there slide pins 27, each rigid with a slider 28, 29 guided in a groove 100 provided in the lower part 15 of the mechanism 1.

Each slider 28, 29 is formed from a plate 30 from which there rises the pin 27 which is constrained to slide in the corresponding guide plate 26, and which comprises a seat 31 shaped as an interrupted circle to receive a substantially annular stop body 32 from the upper face of which there rise in diametrically opposite positions two projections 34 the purpose of which is to enable the annular body 32 to be rotated with the corresponding combination disc 6, 7.

For this purpose, each combination disc 6, 7 comprises on its lower face 35 behind the face 8 carrying the alphanumerical characters a toothing 36 (only partly shown in FIGS. 2 and 4) which with said projections engage. Naturally, said toothing 36 is shaped in such a manner as to enable the stop body 32 to make radial movements relative to the corresponding combination disc.

On the opposite side to that carrying the projections 34, each stop body 32 comprises a radial slot 38 preferably closed outwards and opening into a central hole 39 in the body 32. In said central hole 39 of each body 32, there is present a projection 40 formed by bending a tab on the lower part 3 of the casing 1 towards the upper part 2 (see FIG. 4).

This projection 40, disposed in fact orthogonal to the lower part 3 of the casing 1, is formed in such a manner that it can be inserted into the radial slot 38 when the pins 27 slide in the guide tracks of the mobile element 5. In this respect, as a result of ths sliding both sliders 28 and 29 slide towards the mobile element 5, with consequent movement of the stop bodies 32 in the same direction.

This can obviously only occur if the combination set on the combination discs 6 and 7 is exactly that necessary to obtain opening of the suitcase or the like. Only in this case is the projection 40 aligned with the radial slot 38 thus making it possible to insert the former 40 into the latter 38.

The combination discs 6 and 7 rest (see FIGS. 1 and 4) on discrete steps 41 present in the base part 15 and are circularly constrained by arcuate walls 42 which bound said steps 41. Finally, in addition to the toothing 36 the discs 6 and 7 comprise on their lower face 35 a series of circularly disposed centering recesses 43 into which there penetrate teeth 44 disposed on elastically deformable ledges 45 projecting from a wall 46 of the base part 15.

Figure 5:
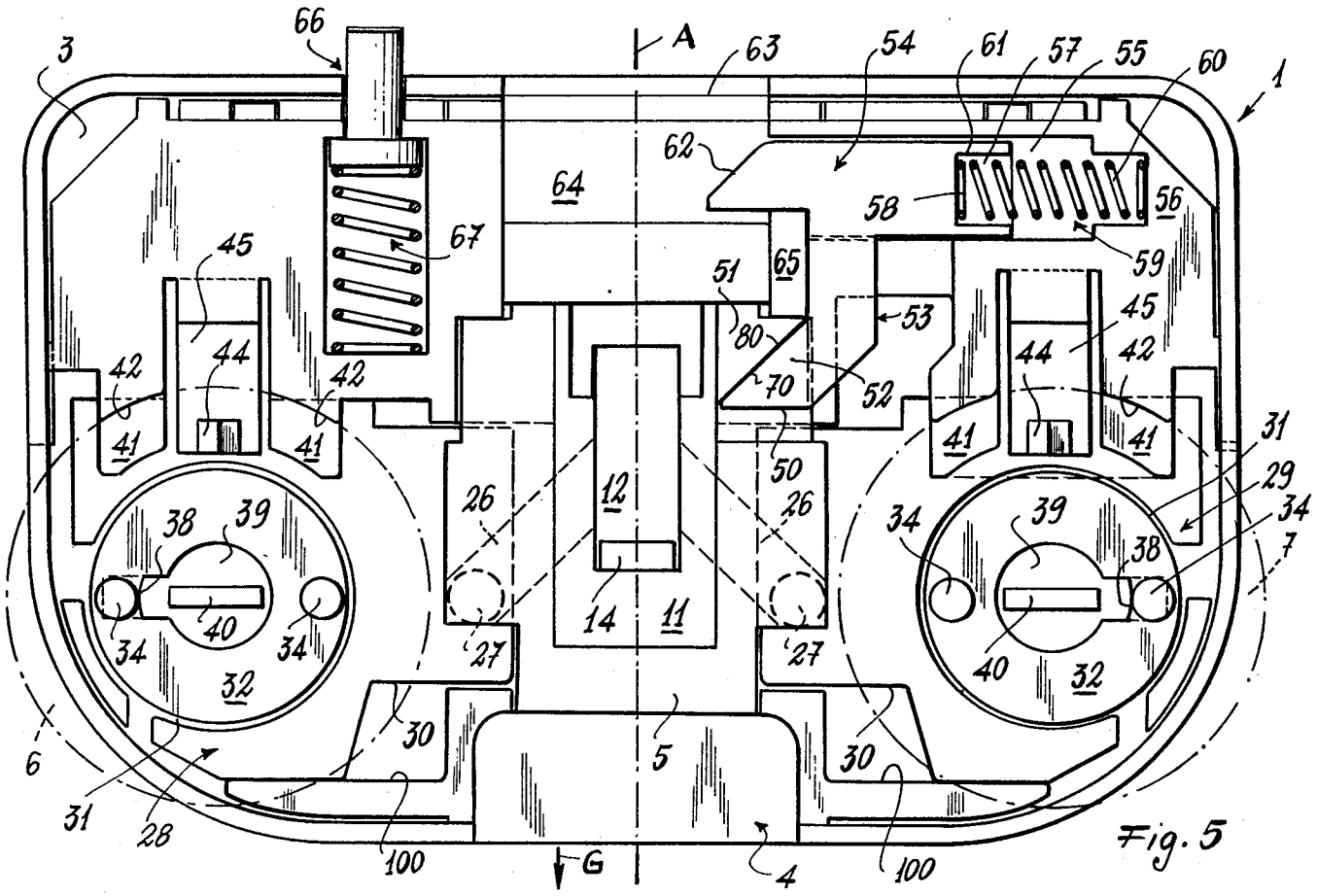
FIG. 5 is a plan view of the lock modified for head-on coupling, after the removal of one of the two constituent components of its box casing.
Figure 6:
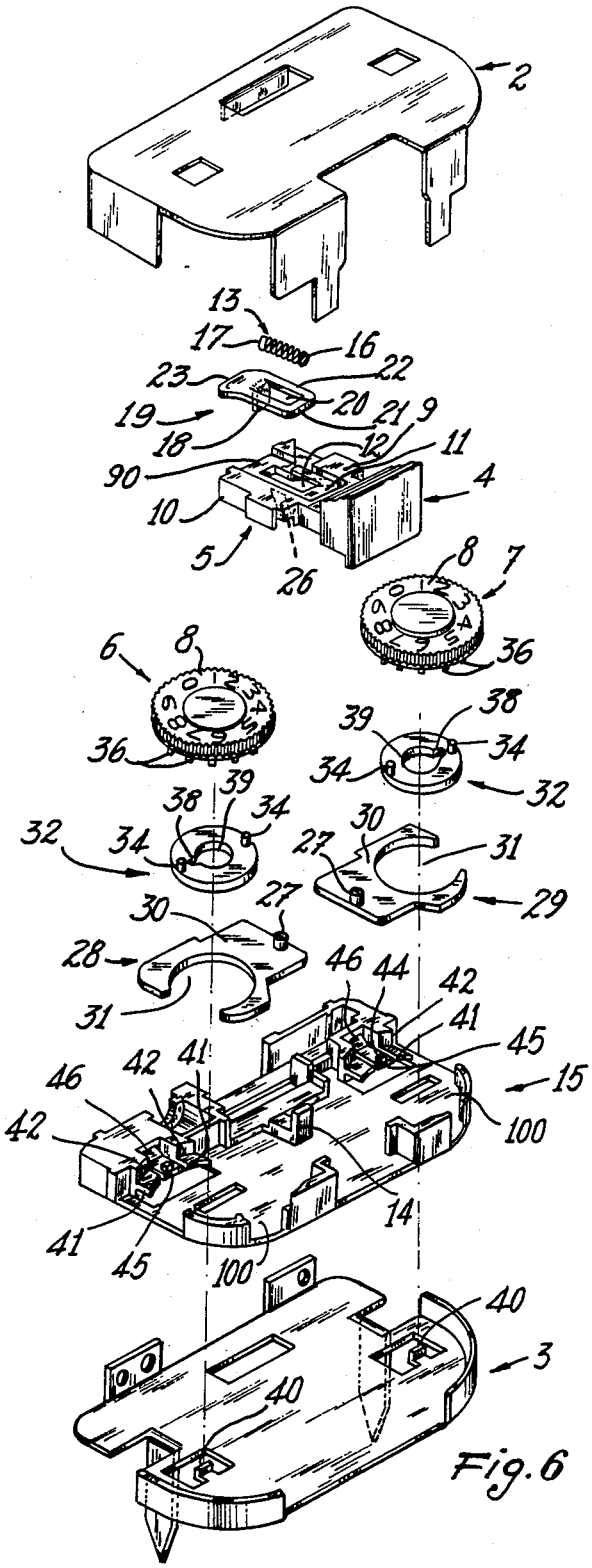
FIG. 6 is an exploded perspective view of the lock of FIGS. 1–4.

FIG. 5 shows the casing 1 of a combination lock for head-on coupling. In this figure, parts identical to those of FIG. 1 are indicated by the same reference numberal.

Specifically, in the lock for head-on coupling, the compression spring 13 in the elongated hole 12 of the mobile element 5 is omitted as is the coupling means 19 on said element 5 and the Ushaped spring 24 disposed under the arcuate end 23 of said coupling means 19.

The lock shown in FIG. 5 comprises laterally on the sunken zone 11 of the mobile element 5 a recess 50 bounded upperly in FIG. 5 by the inclined face 80 of a substantially triangular appendix 51 forming part of the element 5. In said cavity 50 there is disposed one end 52 of an arm 53, this end resting on the mobile element 5 and having an inclined side 70 slidable on the inclined face 80 of the appendix 51. Said arm 53 is rigid with coupling means 54 mobile in a slide trac 55 provided in the base part 15 and orthogonal to the axis A, and bounded by one end of a shoulder 56 of the base part 15 rigid with the lower part 3 of the casing 1.

The coupling means 54 have the end opposite said shoulder 56 recessed at 57. One end 58 of a compression spring 59 is housed in said recessed end, the other end 60 of the spring resting against the shoulder 56. The end 58 of the spring 59 abuts against a wall 61 of the recessed end 57 and engaged the coupling means 54 to move within the slide track 55.

Said coupling means 54 comprises a head 62 which is distant from the recessed end 57 and is arranged to cooperate with a conventional bayonet striker of a head engagement member which penetrates into the casing 1 through a slot 63 in the casing. A shoulder 65 is provided on the base part 15, in proximity to a cavity 64 into which the head 62 of the coupling means projects, in order to limit the movement of the coupling means 54 towards said cavity 64.

Finally, in a lateral position in the casing 1 there is provided a normal member 66 operated by a spring 67 to facilitate the opening for example of the suitcase or the like following operation of the grip 4.

For the operation of the described locks it will be assumed that the article provided with said lock is to be opened. To do this, the user sets the combination by means of the combination discs 6 and 7 while looking through display windows (not shown) provided in the upper part 2 of the lock casing 1. On setting the combination, the stop bodies 32 assume the positions shown in FIGS. 1 and 5.

The user can now open the article by operating the grip 4. In the case of frontal coupling (FIG. 1), by pulling (arrow F of FIG. 1) the grip 4 rigid with the mobile element 5, the coupling means 19 provided on said element 5 is directly moved. Said coupling means 19 is entrained in the movement of the mobile element 5 by the action of the end 90 (FIG. 3) of this latter on the right-angle bent side 18 of the coupling means 19. The spring 24 therefore facilitates opening of the article by forcing the frontal striker, previously retained by the arcuate end 23 of the means 19, to emerge the slot 25 in the upper part 2 of the casing 1.

In the case of "head-on" coupling (FIG. 5), pulling the grip 4 (arrow G, FIG. 5) causes the side 70 of the arm 53 to slide along the side 80 of the appendix 51, to consequently move the coupling means 54 towards the shoulder 56 against the force of the spring 59. By this means the head 62 of the coupling means 54 disengages from the bayonet striker used in the described type of coupling, to enable the article to be opened, this opening being facilitated by the action of the member 66 acting on the part of the article carrying said striker.

Return of the grip into its rest position in the embodiments of both FIG. 1 and FIG. 5 is determined by the action of the springs 13 and 59 respectively. In addition, the coupling means 19 and 54 are unable to escape from their seats because of the action of the part 22 against the shoulder 14 in the case of the embodiment of FIG.

1 and by the action of the shoulder 65 against the arm 53 in the case of the embodiment of FIG. 5.

If an existing combination is to be changed, the combination discs 6 and 7 are moved into the positions shown in FIGS. 1 and 5. When in these positions, the grip 4 is pulled (arrows F and G in FIG. 1 and 5 respectively), to cause the pins 27 to slide in the inclined guides 26. As a result of this sliding, the sliders 28 and 29 move inwards in the casing to approach each other, and at the same time the stop bodies, entrained by the plates 30, move towards the casing axis A to enable the toothing 36 to disengage from the projections 34. During this movememt the projections 40 penetrate into the radial slots 38 provided in the sides 37 of the rings 33.

At this point, if the grip 4 is kept pulled the combination discs 6 and 7 can be rotated to set a new combination without causing the stop bodies 32 to also rotate. Having chosen the new combination, the grip 4 is released to again engage the projections on the bodies 32 with the toothing 36 on the discs 6 and 7.

The invention as described heretofore by way of non-limiting example comprises a smaller number of components than already existing constructions. It also allows the lock to be easily and quickly adapted to either the frontal or bayonet type of striker, to give the lock considerable versatility. This adaption is done by removing the upper part 2 of the casing 1 and disposing the coupling means 19 or 54 in the mobile element 5 or in the slide track 55 respectively, according to the type of engagement member fixed to the article.

What I claim is:

1. A combination lock for an article comprising at least two relatively movable parts, particularly a suitcase and the like, comprising:

an engagement member having a striker to be fixed to one of said parts of the article;

a combination mechanism fixed to the other of said parts;

coupling means associated with said combination mechanism and cooperating with said engagement member;

a pair of rotatable discs for setting the combination;

a stop body removably engaged with each respective rotatable disc in such manner as to be rotated with this latter during engagement but to enable the combination to be changed during disengagement;

a sliding grip provided with at least a pair of inclined guide tracks;

at least a pair of sliders each carrying a pin and one of said stop bodies, said pin being slidable along said respective inclined guide track, said sliding, which can occur when the correct combination is set, generating an approach movement of said bodies and causing disengagement between said bodies and the rotatable discs to enable the user to change the lock combination, said grip being formed in such a manner as to generate with its movement the disengagement between said engagement member and said coupling means.

2. A lock as claimed in claim 1, wherein said guide tracks are provided on one side of said grip.

3. A lock as claimed in claim 1, wherein said grip comprises a sunken zone in which a seat is provided to receive a compression spring, on said sunken zone there being disposed said coupling means frontally cooperating with the engagement member.

4. A lock as claimed in claim 3, wherein said coupling means frontally cooperating with the engagement member comprises an axial slot, at one end of which there is located a right-angle bent side which penetrates into the seat provided in said grip, said frontal coupling means having an end arranged to cooperate with said striker of the engagement member and disposed in correspondence with a spring arranged to facilitate the release of said engagement member from said mechanism.

5. A lock as claimed in claim 1, wherein said mechanism comprises a base part having a shoulder for housing said grip.

6. A lock as claimed in claim 5, wherein said grip and said coupling means slide along a casing axis, said sliding being limited by the action of a compression spring of said coupling means and of said shoulder against which, during the release of the grip, thereabuts an end of the coupling means surrounding the slot provided in said coupling means.

7. A lock as claimed in claim 1, wherein said grip comprises on one face a sunken zone in which a cavity is provided bounded by an inclined face, an arm rigid with said coupling means being arranged to slide in said cavity and to cooperate head-on with said engagement member, said arm having an inclined side cooperating with said inclined face.

8. A lock as claimed in claim 7, wherein said coupling means comprises a recessed end bounded by a wall, and a head arranged to cooperate with said striker of the engagement member.

9. A lock as claimed in claim 8, wherein said coupling means moves against a spring orthogonally disposed relative to said grip.

10. A lock as claimed in claim 1, wherein each stop body is substantially annular and is mounted in the relative slider in a seat thereof shaped as an interrupted circle.

11. A lock as claimed in claim 10, wherein each annular stop body comprises on a face two opposite projections arranged to cooperate with toothing present on each combination disc to obtain by means of the rotation of said disc, the rotation of the corresponding annular body and a radial slot opening into a central hole, in said hole there being provided a stationary projection arranged to enter said slot when the correct combination has been set.

12. The lock of claim 11, wherein said radial slot is closed outwardly.

13. The lock of claim 6, wherein an end of said compression spring abuts against said shoulder.

14. The lock of claim 1, wherein said sliders are independently mounted from one another.

15. The lock of claim 14, wherein said sliders are arranged to move in a direction perpendicular to direction in which said sliding grip moves, when the correct combination has been set.

* * * * *